US011220767B2

(12) United States Patent
Jitsuda et al.

(10) Patent No.: US 11,220,767 B2
(45) Date of Patent: Jan. 11, 2022

(54) CONNECTION STRUCTURE CONNECTING KNITTING NEEDLE BODY AND CABLE AND CIRCULAR KNITTING NEEDLE HAVING THE SAME

(71) Applicant: Clover Mfg. Co., Ltd., Osaka (JP)

(72) Inventors: Toshiharu Jitsuda, Osaka (JP); Mayumi Matsumoto, Osaka (JP); Shinichi Kitao, Osaka (JP)

(73) Assignee: CLOVER MFG. CO., LTD., Osaka (JP)

( * ) Notice: Subject to any disclaimer, the term of this patent is extended or adjusted under 35 U.S.C. 154(b) by 51 days.

(21) Appl. No.: 16/739,936

(22) Filed: Jan. 10, 2020

(65) Prior Publication Data

US 2020/0232131 A1 Jul. 23, 2020

(30) Foreign Application Priority Data

Jan. 18, 2019 (JP) ..... JP2019-006971

(51) Int. Cl.
*D04B 3/02* (2006.01)
*D04B 35/02* (2006.01)
(Continued)

(52) U.S. Cl.
CPC ..... *D04B 3/02* (2013.01); *D04B 33/00* (2013.01); *D04B 35/02* (2013.01); *D05B 85/00* (2013.01)

(58) Field of Classification Search
CPC ..... D04B 3/02; D04B 33/00
(Continued)

(56) References Cited

U.S. PATENT DOCUMENTS 2,102,600 A * 12/1937 Miller ..... D04B 3/02 66/117
2,183,791 A * 12/1939 Dunn ..... D04B 3/02 66/117
(Continued)

FOREIGN PATENT DOCUMENTS

CN 203559213 U 4/2014
DE 3816438 A1 * 11/1989 ..... D04B 3/02
(Continued)

OTHER PUBLICATIONS

Office Action received in the corresponding UK Patent application, dated Jun. 18, 2020 (5 pages).

*Primary Examiner* — Khoa D Huynh
*Assistant Examiner* — Grace Huang
(74) *Attorney, Agent, or Firm* — Hamre, Schumann, Mueller & Larson, P.C.

(57) ABSTRACT

A connection structure includes a proximal end of a needle body, a metallic connector fixed to the proximal end, and an end of a flexible cable attached to the connector. The connector includes a shaft and a head diametrically greater than the shaft. The proximal end of the needle body has a hole into which the shaft of the connector is fitted. The head of the connector has a cable recess accommodating the end of the cable. The cable recess includes a first recess adjacent to an opening of the cable recess and a second recess adjacent to and diametrically greater than the first recess. The end of the cable includes a first portion accommodated in the first recess and a second portion connected to the first portion and accommodated in the second recess. The second portion is diametrically greater than the first portion.

7 Claims, 9 Drawing Sheets

(51) Int. Cl.
*D04B 33/00* (2006.01)
*D05B 85/00* (2006.01)

(58) Field of Classification Search
USPC ..... 66/117, 118
See application file for complete search history.

(56) References Cited

U.S. PATENT DOCUMENTS

| | | | | | |
|---|---|---|---|---|---|
| 2,208,124 | A * | 7/1940 | Dunn | D04B 3/02 | 66/117 |
| 4,007,610 | A * | 2/1977 | Linstead | D04B 3/00 | 66/117 |
| 4,494,387 | A * | 1/1985 | Phipps | D04B 3/02 | 66/117 |
| 4,646,543 | A * | 3/1987 | Okada | D04B 3/02 | 66/117 |
| 4,680,947 | A * | 7/1987 | Phipps, Sr. | D04B 3/02 | 66/117 |
| 6,904,773 | B1 * | 6/2005 | Cushman | D04B 3/02 | 66/1 A |
| 7,954,342 | B2 * | 6/2011 | Devagnanam | D04B 3/02 | 66/117 |
| 9,181,641 | B1 * | 11/2015 | Moraca | D04B 3/02 | |
| 10,106,922 | B2 * | 10/2018 | Papenfuss | D04B 3/02 | |
| 10,443,164 | B1 * | 10/2019 | Zheng | D04B 3/02 | |
| 2020/0040494 | A1 | 2/2020 | Zheng | | |

FOREIGN PATENT DOCUMENTS

| | | | |
|---|---|---|---|
| JP | 55-8633 | U | 6/1978 |
| JP | 2-003491 | U | 1/1990 |
| JP | 5-302248 | A | 11/1993 |

* cited by examiner

CONNECTION STRUCTURE CONNECTING KNITTING NEEDLE BODY AND CABLE AND CIRCULAR KNITTING NEEDLE HAVING THE SAME

FIELD

The present disclosure relates to a connection structure for connecting a knitting needle body and a flexible cable and also relates to a circular knitting needle having the connection structure.

BACKGROUND

Circular knitting needles are a type of knitting needles conventionally used for hand knitting. A circular knitting needle generally includes a pair of needle bodies (made of bamboo, for example) and a flexible cable having ends supported on the needle bodies. The cable is made of a synthetic resin such as a nylon resin. During knitting with a circular knitting needle, stitches are knitted on the needle bodies and slid to the cable as necessary. JP-A-H05-302248 and JP-U-H02-3491 disclose circular knitting needles including a cable and a needle body connected to each other by a metallic connector.

According to JP-A-H05-302248, the metallic connector has a shaft at the distal end. The shaft is inserted into a hole in the proximal end of the needle body, and the metallic connector is secured to the needle body with an adhesive. The metallic connector has a connection hole in the proximal end. One end of the cable is inserted into the connection hole, and the cable is secured to the metallic connector by swaging the proximal end of the metallic connector. That is, the cable is secured to the needle body via the metallic connector and not rotatable relative to the needle body. With the circular knitting needle having this connection structure, however, the cable tends to twist during knitting.

The circular knitting needle disclosed in JP-U-H02-3491 includes a tubular metallic connector. The metallic connector is fitted over and secured to the proximal end of a needle body. The cable has an enlarged end for engagement. This connection structure allows rotation of the cable relative to the metallic connector and the needle body. Thus, twisting of the cable is prevented during knitting. In addition, since the end of the cable fitted in the proximal end of the metallic connector is enlarged for engagement, detachment of the cable from the needle body is prevented.

However, the process of manufacturing this circular knitting needle is rather complex. First, a cable is passed through a tubular metallic connector, and then the end of the cable is processed to form an enlarged portion for engagement. After that, the distal end of the metallic connector is fitted over the proximal end of the needle body, and the metallic connector is secured to the needle body with an appropriate means such as adhesive. In addition, in a case where the metallic connector is made of brass, the surface may deteriorate (oxidized) to become tacky. Since the metallic connector is configured to be fitted over a needle body, the metallic connector has a tubular portion of a certain length. Such a long and tacky metallic connector interferes with smoothly sliding stitches over the needle bodies during knitting.

SUMMARY

In light of the above circumstances, the present disclosure aims to provide a connection structure suitable for connecting a needle body and a cable.

According to a first aspect of the present disclosure, there is provided a connection structure including: a proximal end of a needle body; a metallic connector fixed to the proximal end of the needle body; and an end of a flexible cable attached to the connector. The connector includes a shaft and a head greater in diameter than the shaft. The proximal end of the needle body is formed with a hole into which the shaft of the connector is fitted. The head of the connector is formed with a cable recess accommodating the end of the cable. The cable recess includes a first recess adjacent to an opening of the cable recess and a second recess adjacent to and greater in diameter than the first recess. The end of the cable includes a first portion accommodated in the first recess and a second portion connected to the first portion and accommodated in the second recess, where the second portion is greater in diameter than the first portion.

Preferably, the connection structure further includes an auxiliary member made of a resin and disposed between the needle body and the connector. The auxiliary member includes a tubular shaft inserted into the hole of the needle body and a tubular flange that is connected to and greater in outer diameter than the tubular shaft. The shaft of the connector, as inserted into the auxiliary member, extends through the tubular flange and the tubular shaft.

Preferably, the end of the cable has an enlarged portion connected to the first portion and disposed opposite to the second portion with respect to the first portion. The enlarged portion is greater in diameter than the first portion. The proximal end of the needle body, the tubular flange of the auxiliary member, the head of the connector and the enlarged portion of the cable collectively form an outer surface tapering from the needle body toward the cable.

Preferably, the auxiliary member contains a coloring agent.

Preferably, an entirety of the connector is formed as a single piece.

According to a second aspect of the present disclosure, there is provided a circular knitting needle including: a first needle body having a first proximal end; a second needle body having a second proximal end; and a flexible cable having a first end and a second end that are connected to the first proximal end and the second proximal end, respectively. The connection between the first proximal end of the first needle body and the first end of the cable includes a connecting structure in accordance with the first aspect of the present disclosure. In addition, the connection between the second proximal end of the second needle body and the second end of the cable may also include a connecting structure in accordance with the first aspect of the present disclosure.

Other features and advantages of a connection structure connecting a needle body and a cable and of a circular knitting needle will become more apparent from the detailed description given below with reference to the accompanying drawings.

DRAWINGS

EMBODIMENTS

Embodiments of circular knitting needles and the connection structures connecting a needle body and a cable will be described with reference to the accompanying drawings.

Figure 1:
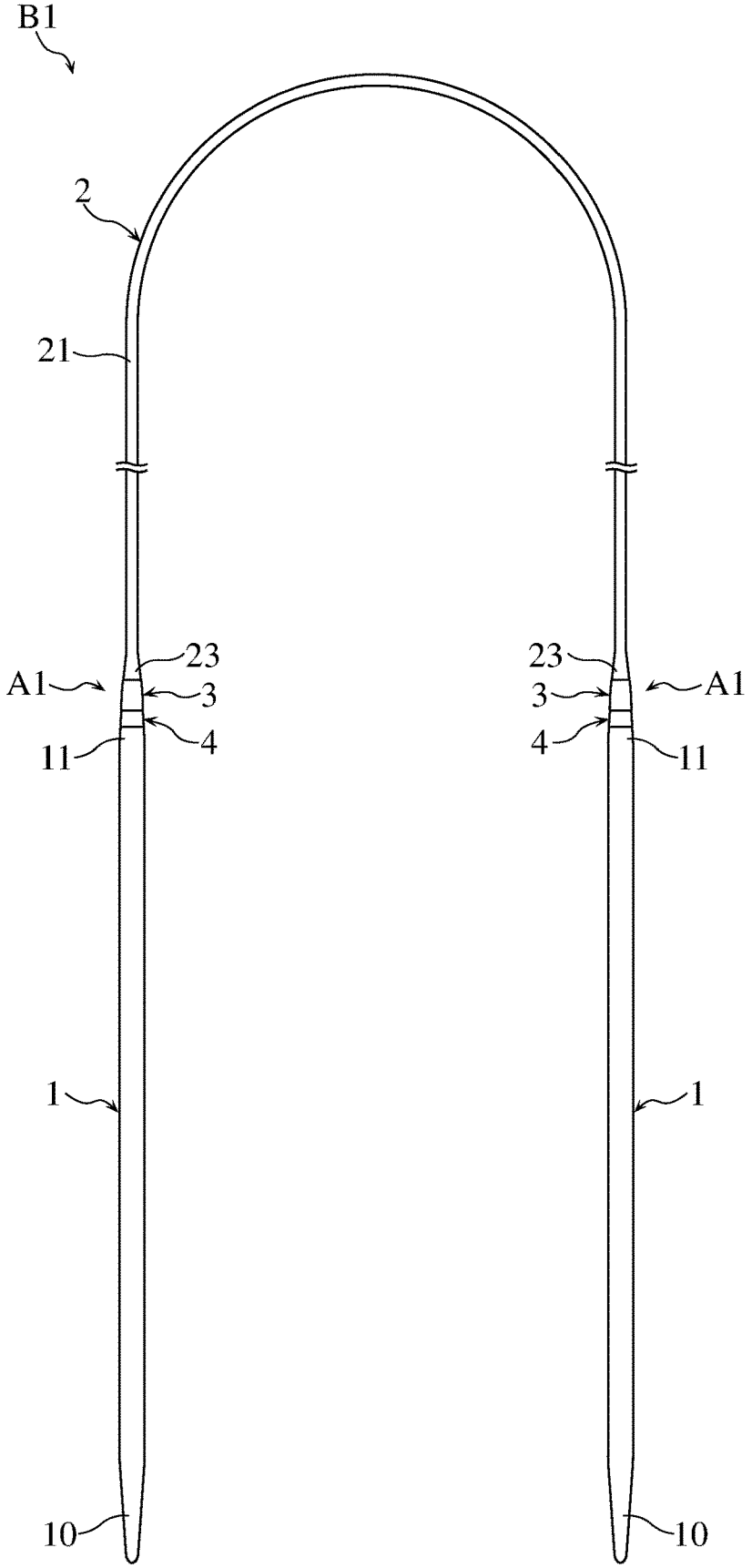
FIG. 1 shows an overall view of a circular knitting needle according to an embodiment.
Figure 2:
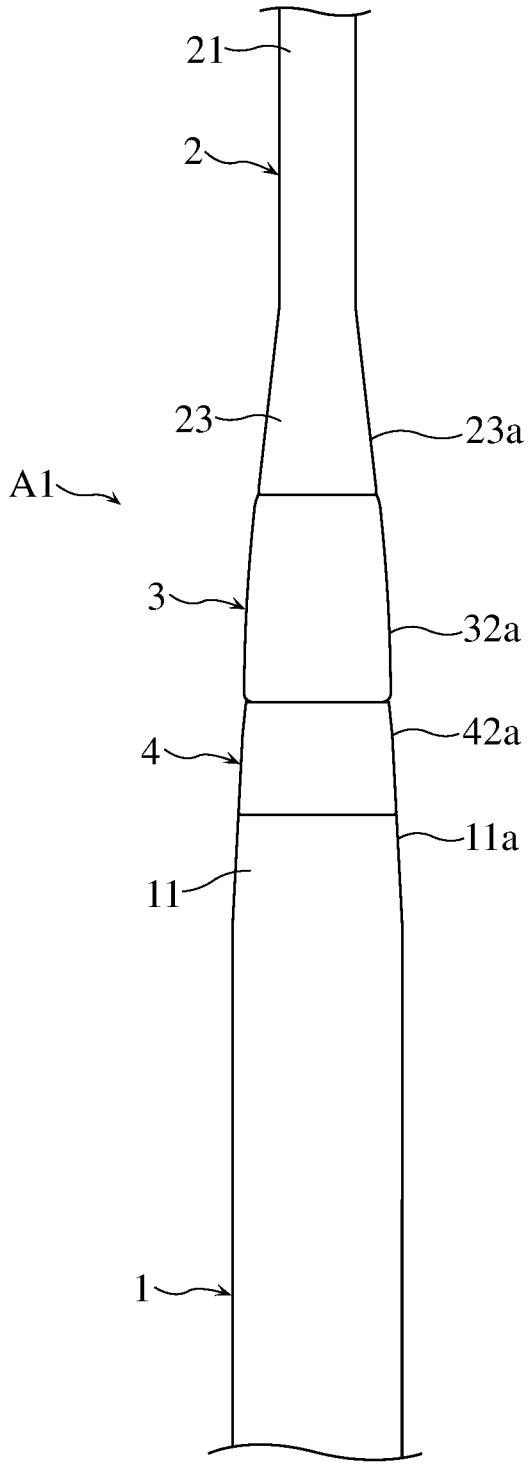
FIG. 2 is a partially enlarged view of the circular knitting needle shown in FIG. 1.
Figure 3:
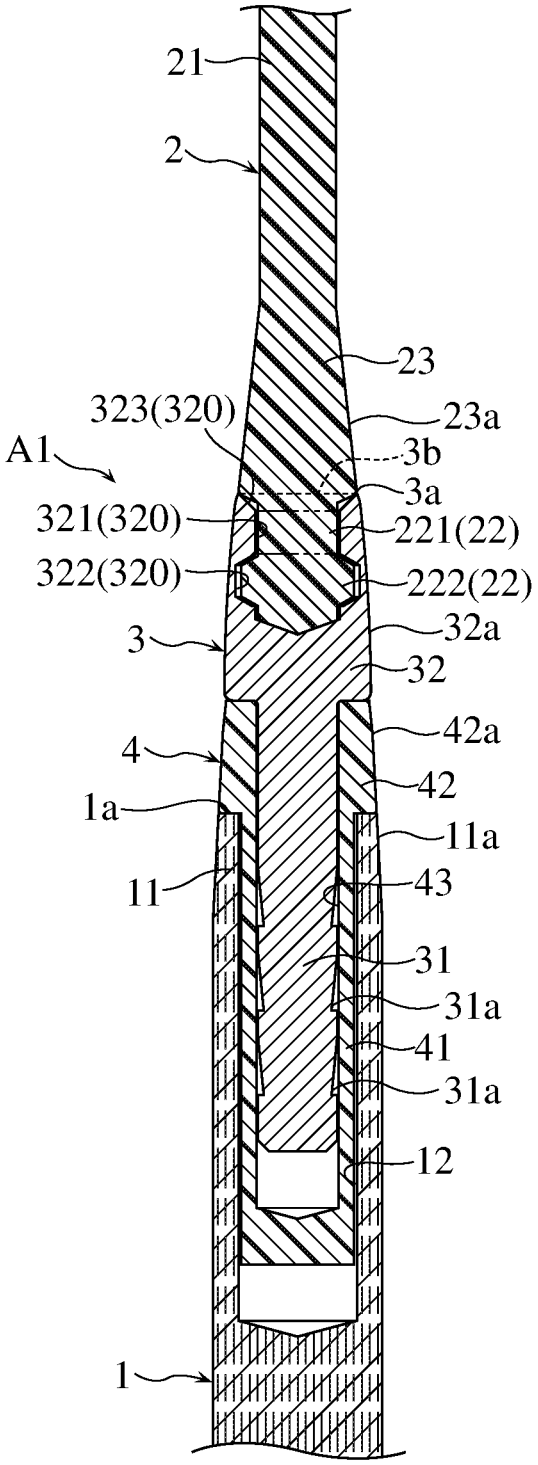
FIG. 3 is a longitudinal cross sectional view of FIG. 2, showing the connection structure of a needle body and a cable according to an embodiment.

FIGS. 1 to 3 show a circular knitting needle B1 according to an embodiment. The circular knitting needle B1 includes a pair of needle bodies 1, a cable 2, a pair of metallic connectors 3 and a pair of auxiliary members 4.

Each needle body 1 is made of bamboo or wood and has a tapered needle tip 10 at the distal end. The size (diameter) of the needle body 1 may be about 3 to 10 mm.

Each needle body 1 has a proximal end 11 which supports an end portion 22 of the cable 2 (see FIG. 3) via a metallic connector 3 and an auxiliary member 4. FIG. 3 shows an embodiment of a connection structure A1 connecting the needle body 1 and the cable 2.

As shown in FIG. 3, the needle body 1 has a hole 12 formed in the proximal end 11. In one example, the hole 12 has a uniform diameter and extends a predetermined depth from the end face 1*a* of the needle body 1. In the present embodiment, a tubular shaft 41 (described later) of the auxiliary member 4 is inserted into the hole 12. The proximal end 11 has an outer peripheral surface 11*a* that includes a gently tapered portion toward the end face 1*a*.

The cable 2 is made of a soft thermoplastic resin, such as a nylon resin, and has flexibility. The cable 2 has a cord portion 21 of a predetermined length, a pair of enlarged portions 23 connected the cord portion 21, and a pair of end portions 22 connected to the enlarged portions 23. The cord portion 21 has a circular transverse cross section that is uniform throughout its length. Each enlarged portion 23 is lager in diameter than the cord portion 21. The enlarged portion 23 has an outer peripheral surface 23*a* that gently flares out toward the end portion 22. Details of the end portions 22 will be described later.

The cord portion 21 of the cable 2 can be provided in any of a variety of lengths. Thus, the circular knitting needle B1 can be provided in any of a variety of total lengths (i.e., the length including the needle bodies 1 and the cable 2). Therefore, a plurality of circular knitting needles B1 can be provided in a variety of total lengths for users to choose from.

Each metallic connector 3 is a metal part used for coupling a needle body 1 and the cable 2. The metallic connector 3 includes a shaft 31 and a head 32. The shaft 31 is substantially cylindrical and located at the distal end of the metallic connector 3. In the present embodiment, the shaft 31 has a plurality of grooves 31*a* in the outer peripheral surface. The grooves 31*a* are annular grooves and spaced from each other along the axial direction of the shaft 31. The grooves 31*a* define a serrated surface.

As shown in FIG. 3, the shaft 31 is inserted into the auxiliary member 4 to extend through both a tubular flange 42 (described layer) and the tubular shaft 41. As shown in FIG. 3, in addition, the shaft 31 is fitted in the tubular shaft 41 of the auxiliary member 4, which in turn is fitted in the hole 12 of the needle body 1. Although not illustrated, an adhesive is applied between the shaft 31 and the auxiliary member 4 (the tubular shaft 41 and the tubular flange 42), so that the shaft 31 (the metallic connector 3) is adhesively joined to the auxiliary member 4.

The head 32 is located at the proximal end of the metallic connector 3 and has a larger outer diameter than the shaft 31. The head 32 has an outer peripheral surface 32*a* gently tapered toward the proximal end 3*a*. The outer peripheral surface 32*a* of the head 32 is larger in diameter than the outer peripheral surface 23*a* of the enlarged portion 23 of the cable 2.

The head 32 has a cable accommodating recess or cable recess 320 for accommodating an end portion 22 of the cable 2. The cable recess 320 has an opening 3*b* at the proximal end 3*a* of the metallic connector 3 and a bottom located toward the distal end of the metallic connector 3. The cable recess 320 includes a first recess 321 and a second recess 322. The first recess 321 is circular in transverse cross section and directly communicates with the opening 3*b*. The first recess 321 is adjacent to the opening 3*b*. In the present embodiment, a guide portion 323 connected to the first recess 321 is formed at the proximal end of the metallic connector 3. The guide portion 323 flares out from the first recess 321 to the opening 3*b*.

The second recess 322 is connected to the first recess 321 at a side toward the distal end of the metallic connector 3. The second recess 322 has a part that is larger in diameter than the first recess 321.

Examples of the material of the metallic connector 3 include brass and aluminum. The metallic connector 3 of the above configuration is formed by appropriate processing, such as forging, cutting, welding, fitting and/or screw joint. In the present embodiment, the metallic connector 3 is formed of a single piece by cutting. However, the processing for forming the metallic connector 3 is not limited to such. For example, the metallic connector 3 may be formed of two or more pieces fitted together.

The end portion 22 of the cable 2 includes a first portion 221 and a second portion 222. The first portion 221 is connected to the enlarged portion 23. The first portion 221 is a cylindrical portion held in the first recess 321 of the cable recess 320 (of the metallic connector 3). The second portion 222 is connected to the first portion 221 and accommodated in the second recess 322 of the cable recess 320. The second portion 222 is larger in diameter than the first portion 221 and has a part larger in diameter than the first recess 321. With the first portion 221 and the second portion 222, the end portion 22 (of the cable 2) is prevented from being disengaged from the metallic connector 3.

The outer diameter of the first portion 221 is smaller than the inner diameter of the first recess 321. Thus, a slight clearance is present between the first recess 321 and the first portion 221, as well as between the second recess 322 and the second portion 222. The presence of the clearance allows rotation of the first portion 221 and the second portion 222 (cable 2) relative to the metallic connector 3.

The auxiliary member 4 is disposed between the needle body 1 and the metallic connector 3. The auxiliary member 4 is made of a resin, such as fiber reinforced plastic (FRP). The auxiliary member 4 has a tubular shaft 41 and a tubular flange 42. The tubular shaft 41 has the shape of a hollow cylinder with a bottom. The tubular flange 42 is connected to the tubular shaft 41 and has a larger outer diameter than the tubular shaft 41. In a different embodiment, the tubular shaft 41 may be a hollow cylinder having an open bottom, instead of a closed bottom.

The tubular shaft 41 is inserted into the hole 12 of the needle body 1. The outer diameter of the tubular shaft 41 is smaller than the inner diameter of the hole 12. Although not shown, an adhesive is present in a clearance between the needle body 1 and the outer peripheral surface of the tubular shaft 41. As such, the tubular shaft 41 (the auxiliary member 4) is secured to the needle body 1.

The tubular flange 42 and the tubular shaft 41 have the same inner diameter. The tubular shaft 41 and the tubular flange 42 have a continuous connection hole 43 for receiving the shaft 31 of the metallic connector 3.

The outer peripheral surface 42*a* of the tubular flange 42 is tapered toward the cable 2. The outer peripheral surface 42*a* of the tubular flange 42 is larger in diameter than the outer peripheral surface 32*a* of the head 32 of the metallic connector 3, and smaller than the outer peripheral surface 11*a* of the proximal end 11 of the needle body 1.

In the present embodiment, the auxiliary member 4 is provided in a desired color so as to be visually recognizable. The auxiliary member 4 may be colored by adding a coloring agent, such as pigment or dye, to a resin material.

As shown in FIGS. 2 and 3, the proximal end 11 of the needle body 1, the tubular flange 42 of the auxiliary member 4, the head 32 of the metallic connector 3 and the enlarged portion 23 of the cable 2 respectively have the outer peripheral surfaces 11*a*, 42*a*, 32*a* and 23*a* that together define an outer shape gradually tapered from the needle body 1 toward the cable 2.

The following describes a process of manufacturing the circular knitting needle B1 with reference to FIGS. 4 to 8.

Figure 4:
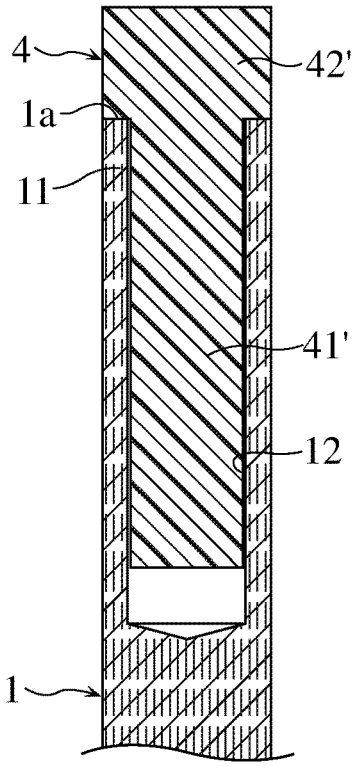
FIG. 4 is a sectional view showing a step of manufacturing a circular knitting needle.

First, as shown in FIG. 4, an auxiliary member 4 is attached to the proximal end 11 of a needle body 1. At this stage, the proximal end 11 of the needle body 1 is not tapered and has a uniform outer diameter. In addition, the auxiliary member 4 does not have a connection hole 43 yet and includes a solid shaft 41' and a solid flange 42'. The outer peripheral surface of the flange 42' is not tapered and has a uniform outer diameter. The auxiliary member 4 is secured to the needle body 1 with an adhesive (not shown).

Figure 5:
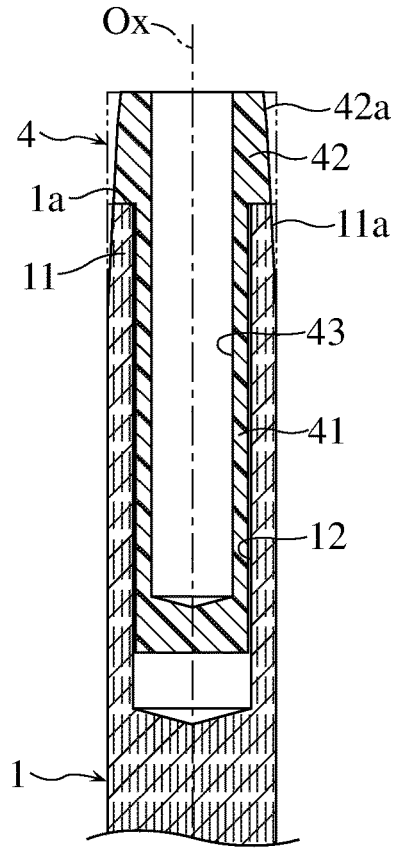
FIG. 5 shows a step subsequent to FIG. 4.

Then, as shown in FIG. 5, a connection hole 43 is formed in the auxiliary member 4. The connection hole 43 is formed by cutting. In addition, the needle body 1 and the auxiliary member 4 are cut to remove unnecessary portions, making the outer peripheral surfaces 11*a* and 42*a* seamlessly tapered. Then, the needle body 1 and the auxiliary member 4 are completed as shown in, for example, FIG. 3. In a case where the needle body 1 made of a natural material of bamboo, the hole 12 may not be formed in precise alignment with the axis of the proximal end 11. In this embodiment, the connection hole 43 is formed after the auxiliary member 4 is secured to the needle body 1. This makes it possible to form the connection hole 43 in alignment with the central axis Ox that is determined based on the outer peripheral surface of the needle body 1.

Figure 6:
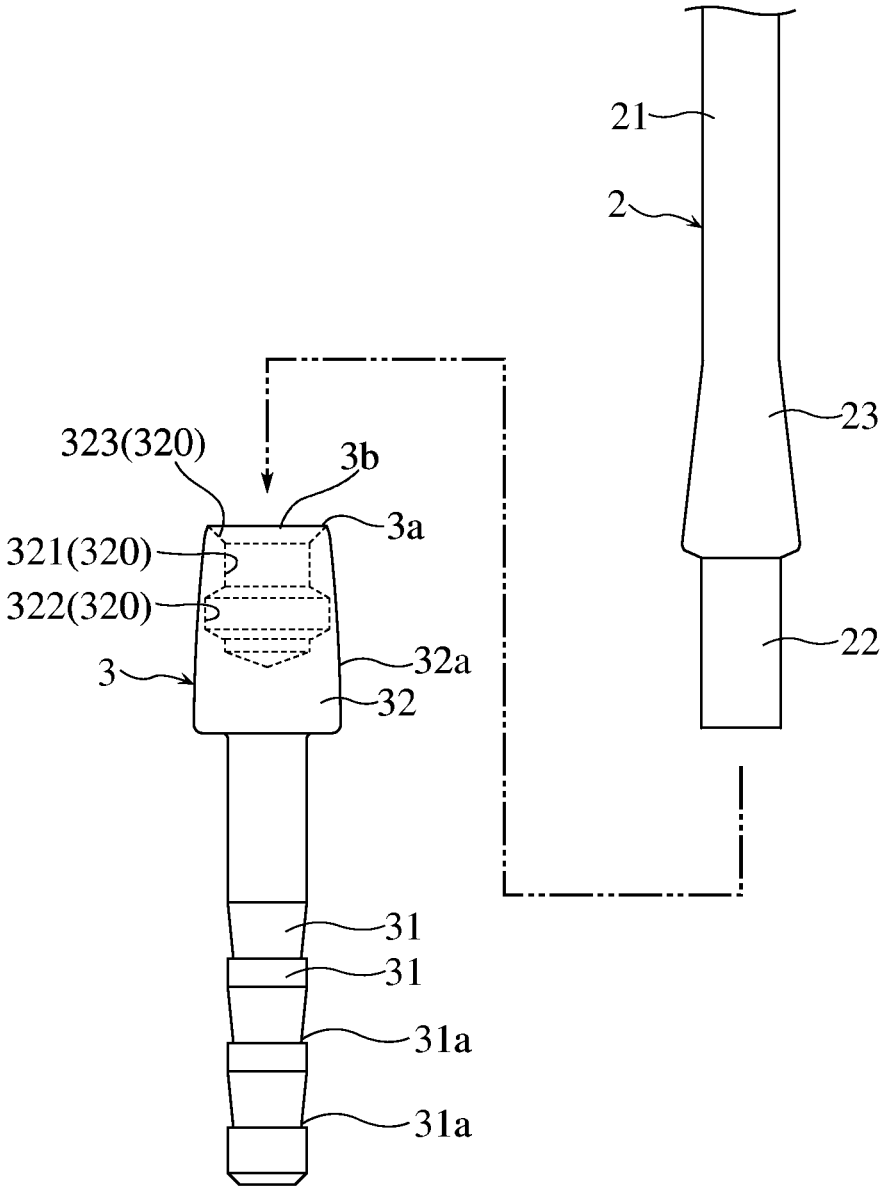
FIG. 6 shows a step subsequent to FIG. 5.

Then, as shown in FIG. 6, a cable 2 is attached to the metallic connector 3. Specifically, an end portion 22 of the cable 2 is inserted into the cable recess 320 of the metallic connector 3. Unlike the end portion shown in FIG. 3, the end portion 22 at this stage has a cylindrical shape with a uniform outer diameter. The end portion 22 has a length determined based on the volume of the cable recess 320 in the metallic connector 3. Before insertion of the end portion 22 into the cable recess 320, the metallic connector 3 is heated to a predetermined temperature, which is higher than the softening temperature of the cable 2. The metallic connector 3 is maintained at the temperature.

Figure 7:
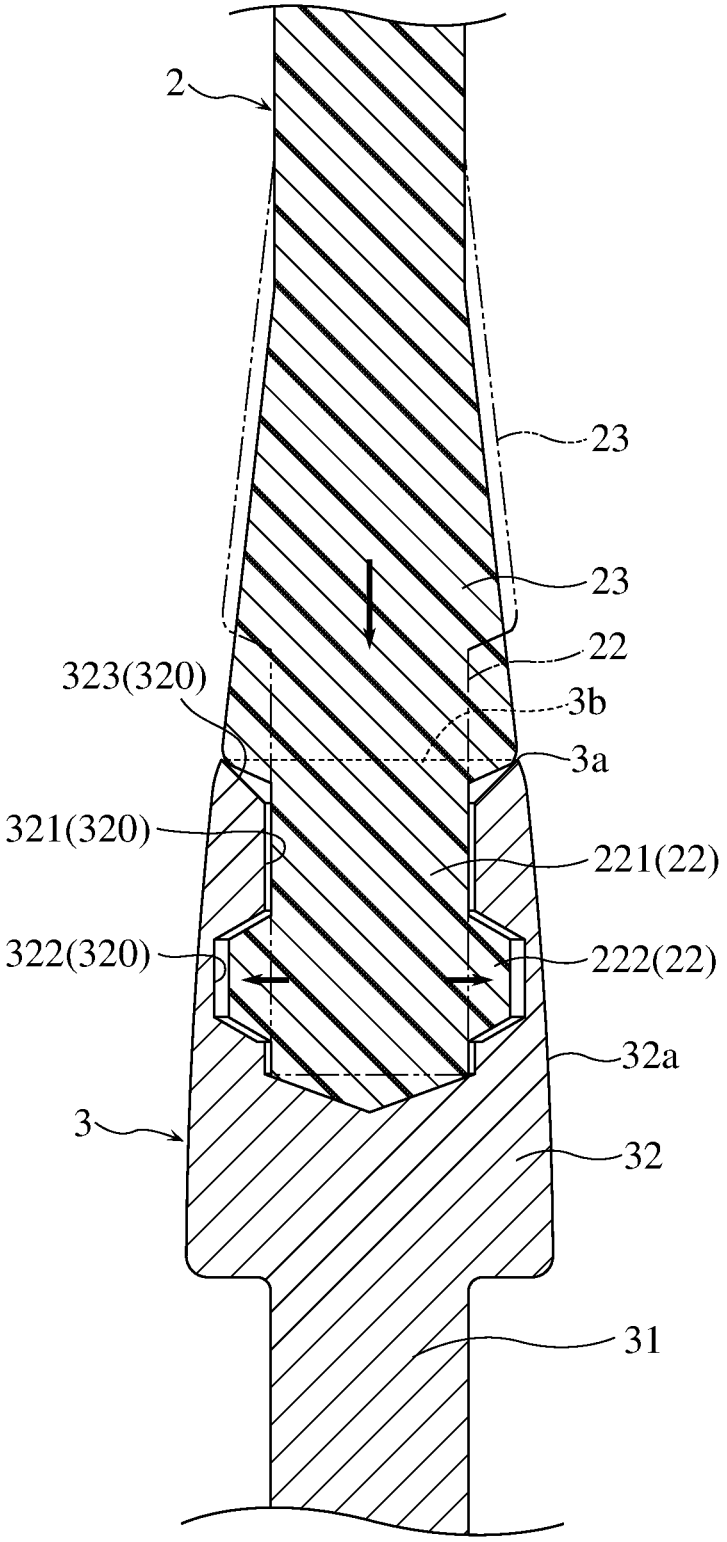
FIG. 7 shows a step subsequent to FIG. 6 on an enlarged scale.

As shown in FIG. 7, the end portion 22 is inserted into the cable recess 320 to push the tip of the end portion 22 against the bottom of the cable recess 320. In this state, heat of the metallic connector 3 is transferred to the end portion 22 to soften the end portion 22. Then, the end portion 22 is further pushed into the cable recess 320, causing the end portion 22 to deform and fill the volume of the second recess 322. The end portion 22 is pushed into the cable recess 320 until the enlarged portion 23 abuts against the proximal end 3*a* of the metallic connector 3. In this way, the end portion 22 is formed to have a first portion 221 relatively smaller in diameter and a second portion 222 relatively larger in diameter. FIG. 7 shows the end portion 22 before the deformation in phantom lines.

The attaching and cutting of the auxiliary member 4 and the needle body 1 shown in FIGS. 4 and 5 maybe performed after the attaching of the cable 2 to the metallic connector 3 shown in FIGS. 6 and 7. Alternatively, the attaching and cutting of the auxiliary member 4 and the needle body 1 may be performed in parallel with the attaching of the cable 2 to the metallic connector 3.

Figure 8:
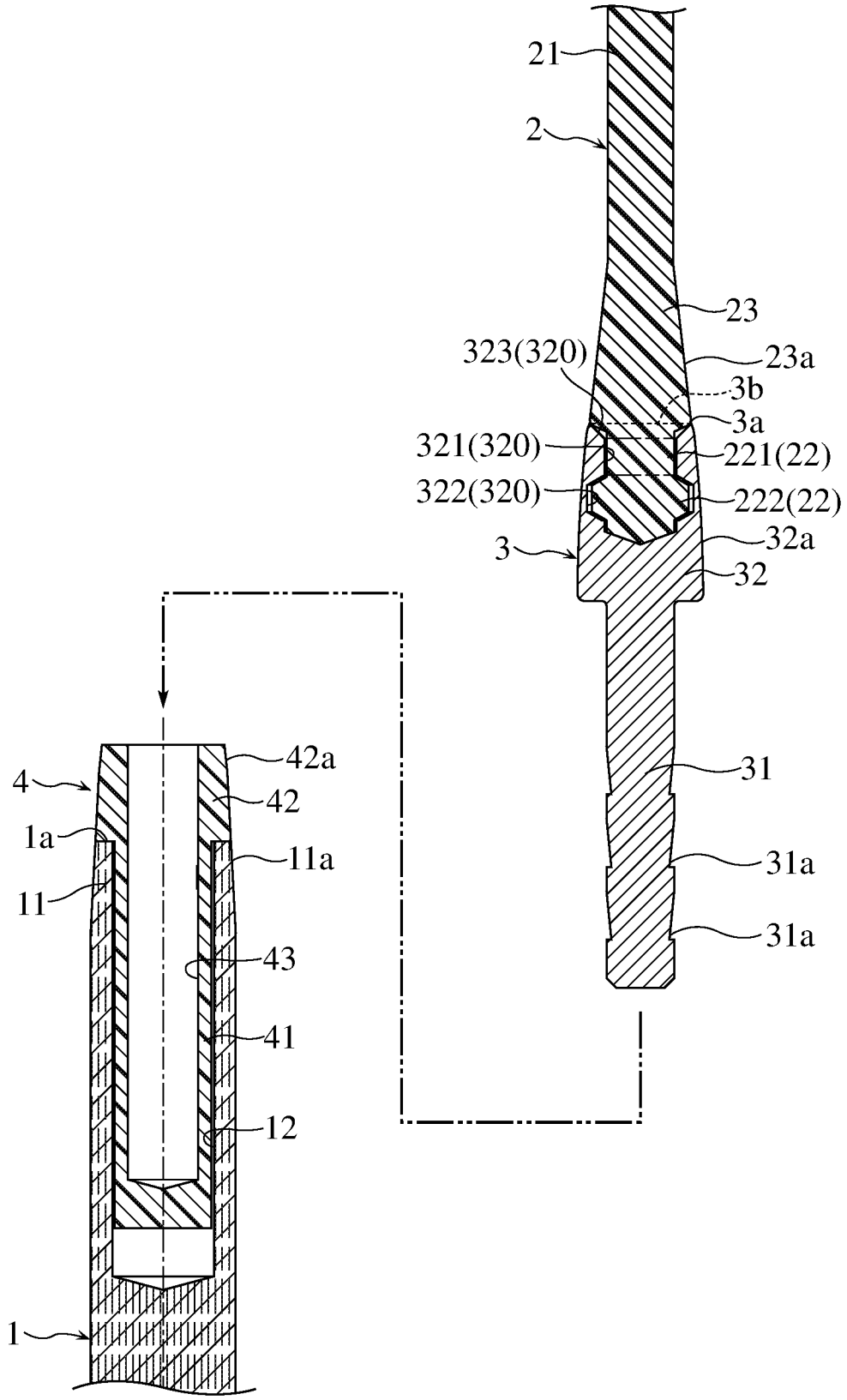
FIG. 8 shows a step subsequent to FIG. 7.

Then, as shown in FIG. 8, the metallic connector 3 is attached to the auxiliary member 4. The shaft 31 of the metallic connector 3 is inserted into the connection hole 43 of the auxiliary member 4. Then, the metallic connector 3 is secured to the auxiliary member 4 with an adhesive (not shown).

By the above steps, the connection structure A1 shown in FIG. 3 is completed to connect the needle body 1 and the cable 2. Although FIGS. 4 to 8 show only one of the pair of needle bodies 1, the other needle body 1 may be processed through the same steps, so that the connection structure A1 is completed to connect the other needle body 1 and the cable 2. The manufacturing process of this embodiment described above provides the circular knitting needle B1 that includes the pair of needle bodies 1, the cable 2, the pair of metallic connectors 3 and the pair of auxiliary members 4.

The following describes advantages of the present embodiment.

According to the present embodiment, the connection structure A1 that connects the needle body 1 and the cable 2 includes the metallic connector 3. The distal end of the metallic connector 3 is secured to the proximal end 11 of the needle body 1. The head 32 at the proximal end of the metallic connector 3 has the cable recess 320 with a bottom. The cable recess 320 includes the first recess 321 and the second recess 322. The second recess 322 is located toward the distal end of the metallic connector 3 and larger in diameter than the first recess 321. The end portion 22 of the cable 2 includes the first portion 221 and the second portion 222. The first portion 221 is a cylindrical portion held in the first recess 321. The second portion 222 is connected to the first portion 221 and accommodated in the second recess 322 of the cable recess 320. The second portion 222 is larger in diameter than the first portion 221 and has a part larger in diameter than the first recess 321.

This configuration prevents detachment of the end portion 22 (cable 2) from the metallic connector 3. In addition, this confutation allows rotation of the first portion 221 and the second portion 222 (cable 2) relative to the metallic connector 3. Thus, the circular knitting needle B1 having the connection structure A1 can be used without twisting of the cable 2 during knitting, providing good usability.

In the present embodiment, the manufacture of the circular knitting needle B1 (the connection structure A1 connecting the needle body 1 and the cable 2) involves attaching the cable 2 to the metallic connector 3 by pushing the end portion 22 of the cable 2 into the cable recess 320 of the metallic connector 3 which has been heated. This provides the end portion 22 having the first portion 221 relatively smaller in diameter and the second portion 222 relatively larger in diameter. For comparison with the present embodiment, a tubular metallic connector is considered. To attach a cable to such a tubular metallic connector, the cable is passed through the metallic connector, and an end of the cable is processed to form an enlarged portion for engagement. Then, the distal end of the connector is fitted over the proximal end of the needle body, and the connector is secured to the needle body using an appropriate means such as adhesive. As compared with this, the present embodiment enables easy attachment of the cable 2 to the metallic connector 3. Therefore, the circular knitting needle B1 (the connection structure A1 of the needle body 1 and the cable 2) can be manufactured easily.

The shaft 31 of the metallic connector 3 is fitted in the connection hole 43 of the auxiliary member 4 and thus in the hole 12 of the needle body 1. That is, the head 32 is the only portion of the metallic connector 3 exposed to the outside. As compared with an entirely tubular metallic connector, the metallic connector 3 has a smaller exposed surface area (i.e., the surface area of the head 32). Even if the metallic connector 3 is made of brass, the surface area of the metallic connector 3 that maybe oxidized is smaller. Accordingly, the resistance interfering with smooth sliding of knitted stitches is ensured to be smaller.

The connection structure A1 of the present embodiment also includes the auxiliary member 4 made of a resin. The auxiliary member 4 is disposed between the needle body 1 and the metallic connector 3. The tubular shaft 41 of the auxiliary member 4 is inserted into the hole 12 of the needle body 1, and the tubular flange 42 of the auxiliary member 4 is connected to the tubular shaft 41. As shown in FIG. 3, the shaft 31 of the metallic connector 3 extends through both the tubular flange 42 and the tubular shaft 41. With the resinous auxiliary member 4 disposed between the needle body 1 and the metallic connector 3, a higher bonding strength is achieved between the needle body 1 and the auxiliary member 4 and also between the auxiliary member 4 and metallic connector 3, than the bonding strength that would be achieved by adhesively joining the metallic connector 3 to the needle body 1.

In addition, since the shaft 31 of the metallic connector 3 extends through both the tubular flange 42 and the tubular shaft 41, a larger bonding area is obtained between the metallic connector 3 and the auxiliary member 4 and also between the needle body 1 and the auxiliary member 4. This improves the bonding strength between the needle body 1, the auxiliary member 4 and the metallic connector 3, and consequently improves the durability of the circular knitting needle B1 (the connection structure A1 connecting the needle body 1 and the cable 2).

As shown in FIG. 3, the cable 2 has the enlarged portion 23. The enlarged portion 23 is larger in diameter than the first portion 221 and connected to the first portion 221 at the opposite side to the second portion 222. The proximal end 11 of the needle body 1, the tubular flange 42 of the auxiliary member 4, the head 32 of the metallic connector 3 and the enlarged portion 23 of the cable 2 (or their outer peripheral surfaces 11*a*, 42*a*, 32*a* and 23*a*) together define an outer shape gradually tapered from the needle body 1 toward the cable 2. With this configuration, a yarn can be smoothly advanced over the joint between the needle body 1 and the cable 2.

The auxiliary member 4 is colored to provide a visual indication. For example, the auxiliary member 4 may be provided in one of a plurality of colors corresponding to the total lengths available for circular knitting needle B1. In this way, the total length of the circular knitting needle B1 can be identified just by looking at the color.

The present disclosure is not limited to the connection structure of the needle body and the cable and the circular knitting needle according to the embodiments described above. Various changes and modification are possible to the elements of the connection structure (the needle body and the cable) and the circular knitting needle without departing from the scope of the appended claims.

Figure 9:
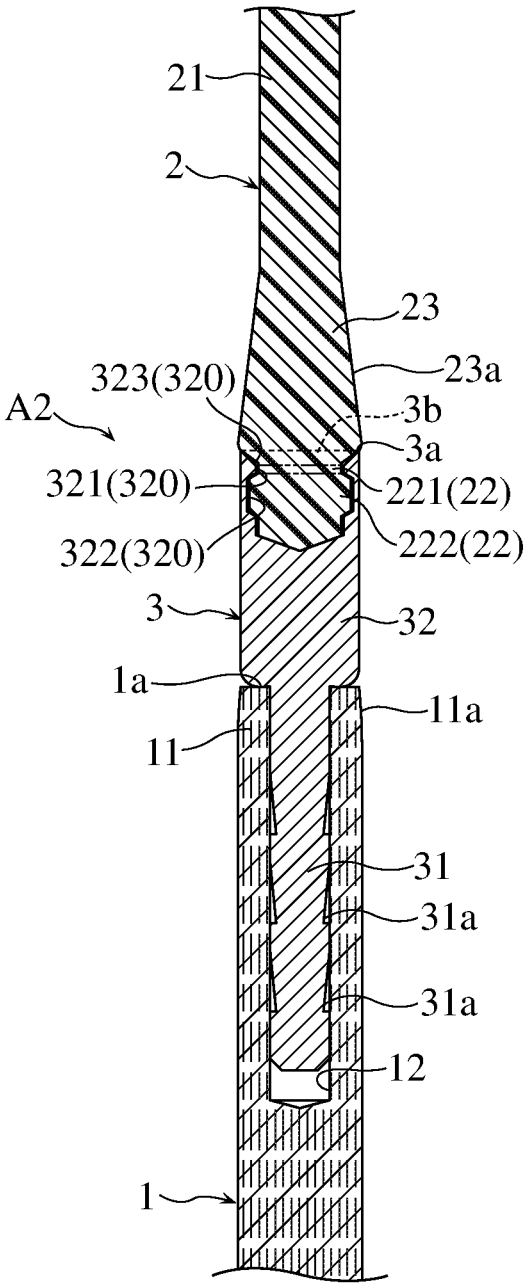
FIG. 9 is a sectional view similar to FIG. 3, showing the connection structure of a needle body and a cable according to a variation.

Although the embodiments described above includes the auxiliary member 4 between the needle body 1 and the metallic connector 3, the auxiliary member 4 may be omitted in other embodiments. FIG. 9 shows a connection structure A2 connecting the needle body 1 and the cable 2 without the auxiliary member 4. The connection structure A2 makes the connection by inserting the shaft 31 of the metallic connector 3 into the hole 12 of the needle body 1. Although not shown, an adhesive is applied to the clearance between the needle body 1 and the outer peripheral surface of the shaft 31. The shaft 31 (the metallic connector 3) is adhesively secured to the needle body 1.

Figure 10:
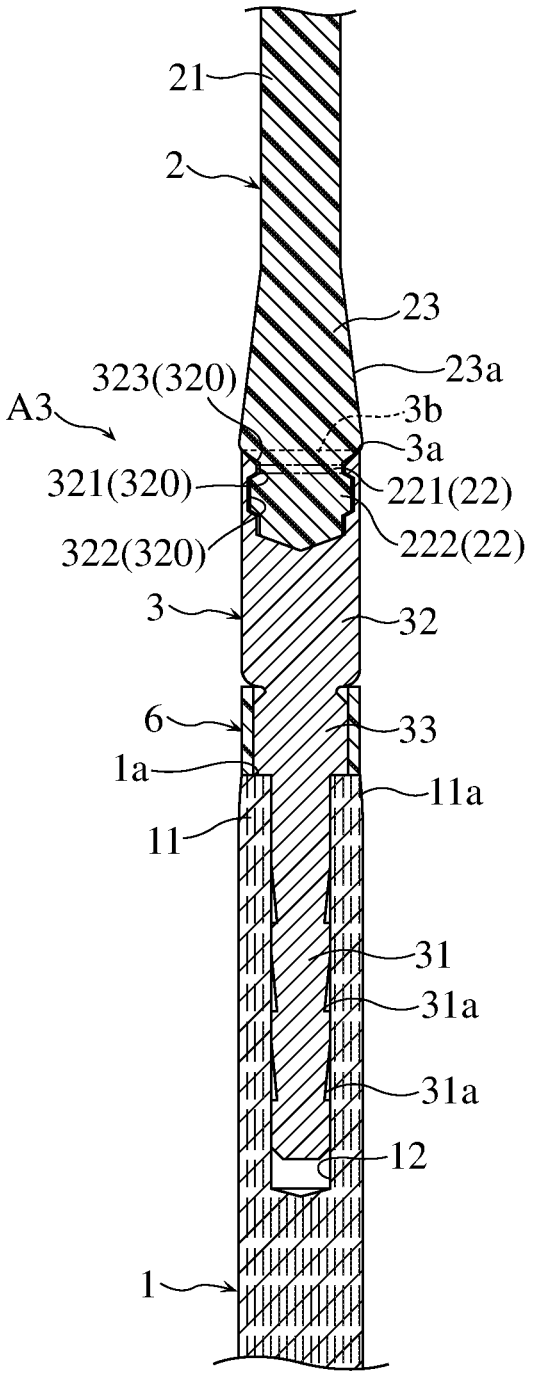
FIG. 10 is a sectional view similar to FIG. 3, showing the connection structure of a needle body and a cable according another variation.

In another embodiment, the auxiliary member 4 may be replaced by an annular member. FIG. 10 shows a connection structure A3 that includes an annular member rather than the auxiliary member 4 to connect the needle body 1 and the cable 2. Similarly to FIG. 9, the connection structure A3 makes the connection by inserting the shaft 31 of the metallic connector 3 into the hole 12 of the needle body 1 and securing the shaft 31 (the metallic connector 3) to the needle body 1. The annular member 6 has the shape of a circular cylinder and fitted over an intermediate portion 33 of the metallic connector 3. The annular member 6 may be made of a resin and colored to any desired color.

The invention claimed is:

1. A connection structure comprising:

a proximal end of a needle body;

a metallic connector fixed to the proximal end of the needle body; and an end of a flexible cable attached to the connector, wherein the connector includes a shaft elongated along a center axis and a head greater in diameter than the shaft, the proximal end of the needle body comprises a hole into which the shaft of the connector is fitted, the head of the connector comprises a cable recess accommodating the end of the cable, the cable recess includes a first recess adjacent to an opening of the cable recess and a second recess adjacent to and greater in diameter than the first recess, the first recess being disposed between the opening and the second recess along the center axis, and the end of the cable includes a first portion accommodated in the first recess and a second portion connected to the first portion and accommodated in the second recess, the second portion being greater in diameter than the first portion.

2. The connection structure according to claim 1, further comprising an auxiliary member made of a resin and disposed between the needle body and the connector, wherein the auxiliary member includes a tubular shaft inserted into the hole of the needle body and a tubular flange that is connected to and greater in outer diameter than the tubular shaft, and the shaft of the connector, as inserted into the auxiliary member, extends through the tubular flange and the tubular shaft.

3. The connection structure according to claim 2, wherein the end of the cable has an enlarged portion connected to the first portion, and the first portion is disposed between the enlarged portion and the second portion, the enlarged portion being greater in diameter than the first portion, and the proximal end of the needle body, the tubular flange of the auxiliary member, the head of the connector and the enlarged portion of the cable collectively form an outer surface tapering from the needle body toward the cable.

4. The connection structure according to claim 2, wherein the auxiliary member contains a coloring agent.

5. The connection structure according to claim 1, wherein an entirety of the connector is formed as a single piece.

6. A circular knitting needle comprising:

a first needle body having a first proximal end;

a second needle body having a second proximal end; and a flexible cable having a first end and a second end that are connected to the first proximal end and the second proximal end, respectively, wherein a first connection between the first proximal end of the first needle body and the first end of the flexible cable comprises a first connection structure, the first connection structure comprises:

the first proximal end of the first needle body;

a first metallic connector fixed to the first proximal end of the first needle body; and the first end of the flexible cable attached to the first metallic connector, wherein the first metallic connector includes a first shaft elongated along a first center axis and a first head greater in diameter than the first shaft, the first proximal end of the first needle body comprises a first hole into which the first shaft of the first metallic connector is fitted, the first head of the first metallic connector comprises a first cable recess accommodating the first end of the flexible cable, the first cable recess includes a first recess adjacent to a first opening of the first cable recess and a second recess adjacent to and greater in diameter than the first recess, the first recess being disposed between the first opening and the second recess along the first center axis, and the first end of the flexible cable includes a first portion accommodated in the first recess and a second portion connected to the first portion and accommodated in the second recess, the second portion being greater in diameter than the first portion.

7. The circular knitting needle according to claim 6, wherein a second connection between the second proximal end of the second needle body and the second end of the cable comprises a second connection structure, the second connection structure comprises:

the second proximal end of the second needle body;

a second metallic connector fixed to the second proximal end of the second needle body; and the second end of the flexible cable attached to the second metallic connector, wherein the second metallic connector includes a second shaft elongated along a second center axis and a second head greater in diameter than the second shaft, the second proximal end of the second needle body comprises a second hole into which the second shaft of the second metallic connector is fitted, the second head of the second metallic connector comprises a second cable recess accommodating the second end of the flexible cable, the second cable recess includes a third recess adjacent to a second opening of the second cable recess and a fourth recess adjacent to and greater in diameter than the third recess, the third recess being disposed between the second opening and the fourth recess along the second center axis, and the second end of the flexible cable includes a third portion accommodated in the third recess and a fourth portion connected to the third portion and accommodated in the fourth recess, the fourth portion being greater in diameter than the third portion.

* * * * *